United States Patent [19]

Bertoli

[11] Patent Number: 4,895,258

[45] Date of Patent: Jan. 23, 1990

[54] COMPACT UTENSIL SET

[75] Inventor: Luigi Bertoli, Lumezzane, Italy

[73] Assignee: Abert Spa Dei Fratelli Bertoli fu Antonio, Italy

[21] Appl. No.: 216,793

[22] Filed: Jul. 8, 1988

[51] Int. Cl.[4] ..... B65D 85/62

[52] U.S. Cl. ..... 206/541; 206/542; 206/546

[58] Field of Search ..... 206/541, 542, 546, 549, 206/216, 217

[56] References Cited

U.S. PATENT DOCUMENTS

| | | | |
|---|---|---|---|
| 2,555,788 | 6/1951 | Donaldson | 206/549 X |
| 4,278,172 | 7/1981 | Ghebresillassie | 206/549 X |
| 4,495,404 | 1/1985 | Carmichael | 206/546 X |
| 4,756,424 | 7/1988 | Schwartz | 206/542 |
| 4,768,530 | 9/1988 | Vaughn | 206/542 |

*Primary Examiner*—William Price

*Attorney, Agent, or Firm*—Handal & Morofsky

[57] ABSTRACT

This invention is a set of items contained in a case-container, the components of which are themselves accessories going to make up the set.

All these utensils together form part of the equipment carried by hikers, hunters, fishermen, sportsmen and campers and used out of doors during their sporting or leisure activity. This set contains all the mains things required for consuming food and drink, neatly arranged within a very limited space. A special feature of the set is that all the component parts are made specially to make best use of the space available, to be compact and hygienic, and to keep weight down to a minimum.

8 Claims, 3 Drawing Sheets

Fig. 6
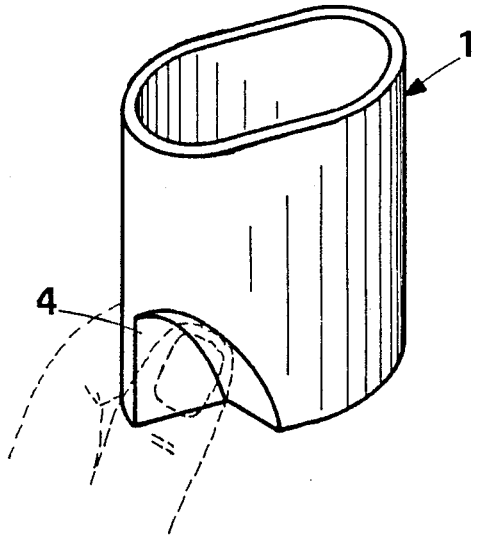
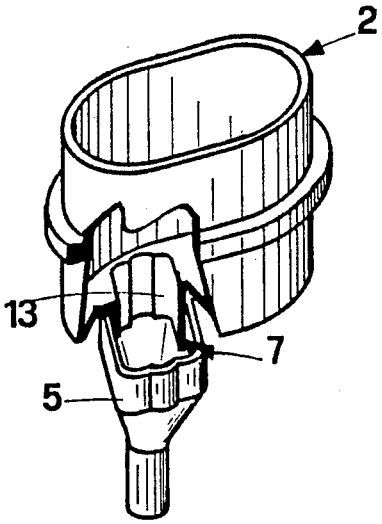
Fig. 7
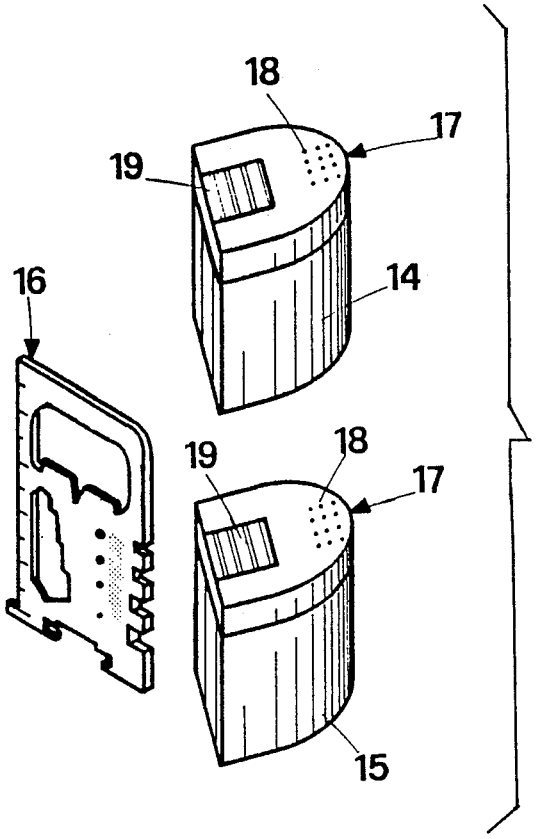
Fig. 8

COMPACT UTENSIL SET

This new invention can be classified among the various types of accessories required for consuming means out of doors (excluding crockery and saucepans) during hikes, excursions or hunting and fishing expeditions. The set is composed of elements designed, studied and tested—particularly as regards the shapes—to satisfy requirements of rationality, tidy arrangement, hygiene and limited dimensions and weight for anyone carrying it during marches, transfers, camps and so on.

The main aim was to produce a combination of elements suitable for these functions and able to satisfy the above requirements. These elements have been specially designed so that they can all fit together in one handy, attractive unit.

This has been made possible by means of an outer case composed of a group of hollow sections for holding everything required for consuming a meal by people on the move out of doors, such as campers. The sections are fitted together to form the container and also serve other functions within the set.

The items contained inside are cutlery, small containers and other things which are useful for this purpose or other special functions.

This special composition offers several advantages.

Various items forming a complete one-man set are neatly contained in a very limited space.

Each item has its own special purpose and use.

As well as acting as containers, the outer hollow sections all serve a second purpose.

All the items contained inside occupy a set position and amount of space.

All the items contained inside have a fixed position to avoid breakage or damage, which might happen if they were loose.

Very little, well-arranged space is taken up for holding everything for an outdoor meal in a single container.

The whole thing can fit neatly into a rucksack, haversack, bag or pocket.

In order to give a clear explanation of this invention, here is a description of a typical set which is neither binding nor limiting, illustrated on the sheet enclosed, where FIG. 1 shows the set closed from the outside, seen from above at angle of three quarters.

FIG. 6 shows the lid upside down with the open end facing upwards.

FIG. 7 shows the central section together with one of the elements held inside the casing.

FIG. 8 shows two inner containers and a multi-purpose device which are part of the set.

Figure 1:
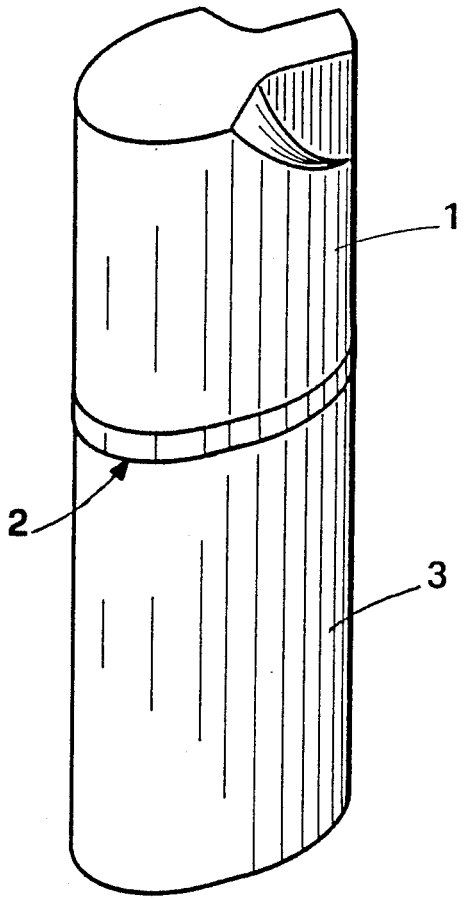
Figure 3:
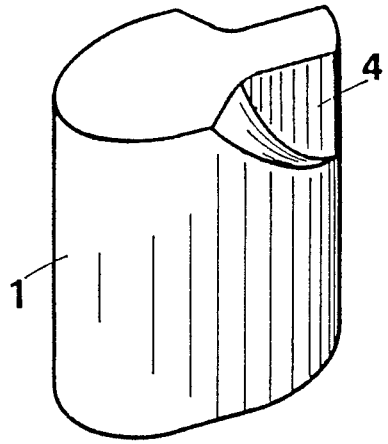
FIG. 3 shows the lid in an upright position.

FIG. 1 shows that the set is compact and linear in shape and occupies very little space. FIG. 6 shows the proportions. FIG. 1 shows the top section or lid (1), the central section (2) and the bottom (3). These three parts fit together to make the outer container and are shown separate in FIGS. 3–5, where they are depicted in position ready to be assembled.

Each of these containers has been designed to perform a different set function.

The lid (1) acts as a coffee cup if the hollow (4) is held between thumb and first finger, as shown in FIG. 6.

Figure 4:
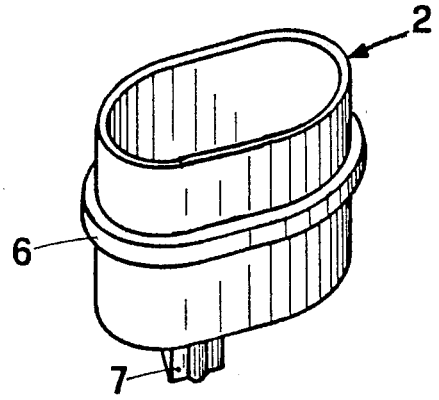
FIG. 4 shows the central section without the elements it holds tightly together.
Figure 5:
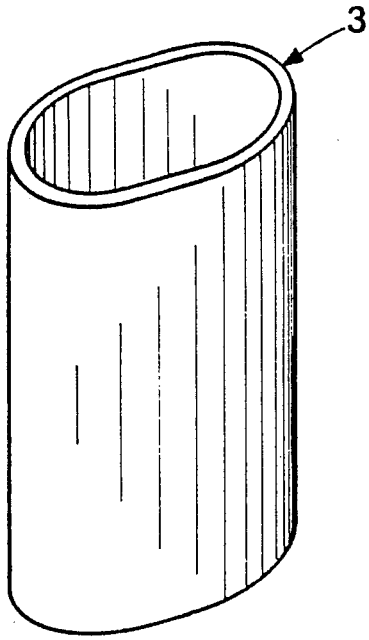
FIG. 5 shows the bottom section of the container.

The central part (2)—see FIG. 4—has an outer rim (6) to enable it to be fitted between the lid (1) and the bottom (3). It holds some of the items in the set. It has a shaped hole (13) in it parallel to the main axis, and a specially shaped projection facing downwards (7).

Item 2 can act as a small funnel when it is fitted with the spout (5), which is necessary for pouring liquids and fits onto the project edge (7). (See FIG. 7)

Part 3 is a long hollow shell without any particular shaping. It acts as the bottom part of the outer container and also as a drinking cup. (See FIG. 5)

Figure 2:
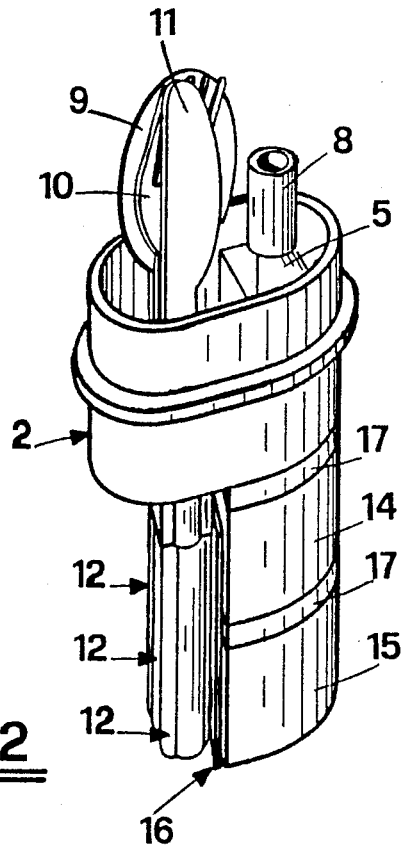
FIG. 2 shows the set without the containers and the items inside shown in the position they are in when the container is closed.

FIG. 2 shows part 2 without the lid (1) and the bottom (3), with all the items it holds compactly inside. These items are as follows. Accessory 5, as has already been shown, is required to make up the funnel. It comes with a filter inside, where the cylindrical part (8) joins the shaped part, and fits onto section 2 with the special projections. The other accessories are the spoon (9), the fork (10) and the knife (11). All the handles (12) are made of plastic which is specially shaped so that they can fit together snugly into the space provided (13). The space below section 2 holds two small containers (15 and 15) which are specially designed to fit exactly into the cavity of section 2 and rest on the bottom. The two containers (14 and 15) each have a lid (17) with holes (18) and opening (19). They are identical and can be used for holding and distributing salt, pepper, sugar, etc. The multi-purpose device (16) fits vertically into the slot between the handles (12) of the cutlery and the containers (14 and 15).

The metal multi-purpose device (16) includes a bottle-opener, a screwdriver, a cartridge extractor, a nail puller, a multi-size bolt or nut runner, a set of holes and slots for wire bending, a wire stripper for various diameters, a spatula, a centimeter scale and a rough surface for lighting sulphur matches. This set of elements can be made of cast, die-cast, blank and drawn metal, plastic or wood, using the traditional technique for making similar accessories.

I claim:

1. A compact, self-containing utensil set comprising:

(a) bottom section having a base, a continuous, closed bottom sidewall wherein said bottom sidewall defines a constant cross-section and an open top, said bottom section defining a first interior volume;

(b) a top section with an open base of the same cross-sectional shape as said open top of said bottom section, a continuous, closed top sidewall and a closed top, said top section defining a second interior volume;

(c) a central section with an outer rim, said outer rim congruent in shape with said constant cross-section defined by said bottom sidewall, an interior section, said interior section defining a shaped hole allowing communication between the interior volume defined by said bottom section and the interior volume defined by said top section, and sidewalls of similar shape to said outer rim capable of snugly fitting within said top sidewall and said bottom sidewall; and (d) an interior component defining a central passage capable of matingly engaging said shaped hole thereby allowing said central section to function as a funnel.

2. A utensil set as claimed in claim 1, further comprising cutlery wherein said cutlery has handles that may pass through said shaped hole in said central section and wherein said cutlery has overall dimensions that permit said top section's open bottom and said bottom section's open top to abut said central section's outer rim thereby achieving a closed position while said cutlery is positioned in said shaped hole of said central section.

3. A utensil set as claimed in claim 2, further comprising two containers, said containers fitting, within said first interior volume when said utensil set is in a closed position.

4. A utensil set as claimed in claim 3, further comprising a flat metal multifunctional plate, said multifunctional plate fitting within said first interior volume when said utensil set is in a closed position.

5. A utensil set as claimed in claim 4, wherein said flat metal multifunctional plate comprises:

(a) a scaled rule;

(b) a bottle opener;

(c) a nail puller;

(d) a screwdriver; and (e) a rough surface section.

6. A utensil set as claimed in claim 1, further comprising a filter element associated with said interior component.

7. A utensil set as claimed in claim 1, wherein said top section has a pinched shape at and near said closed top forming indents thereby providing a gripping area.

8. A utensil set as claimed in claim 1, wherein said utensil set is comprised of molded plastic.

* * * * *